US010330262B2

(12) United States Patent
Mao et al.

(10) Patent No.: US 10,330,262 B2
(45) Date of Patent: Jun. 25, 2019

(54) HEAT EXCHANGE SYSTEM BETWEEN LIQUEFIED NATURAL GAS AND HEAT DISSIPATION APPARATUS

(71) Applicant: CLOUD NETWORK TECHNOLOGY SINGAPORE PTE. LTD., Singapore (SG)

(72) Inventors: Tze-Chern Mao, New Taipei (TW); Chih-Hung Chang, New Taipei (TW); Yen-Chun Fu, New Taipei (TW); Chao-Ke Wei, New Taipei (TW); Yao-Ting Chang, New Taipei (TW); Hung-Chou Chan, New Taipei (TW)

(73) Assignee: Cloud Network Technology Singapore Pte. Ltd., Singapore (SG)

( * ) Notice: Subject to any disclaimer, the term of this patent is extended or adjusted under 35 U.S.C. 154(b) by 161 days.

(21) Appl. No.: 15/149,171

(22) Filed: May 8, 2016

(65) Prior Publication Data

US 2017/0254480 A1 Sep. 7, 2017

(30) Foreign Application Priority Data

Mar. 7, 2016 (CN) ..... 2016 1 0126534

(51) Int. Cl.
*F17C 7/04* (2006.01)
*F17C 7/02* (2006.01)

(52) U.S. Cl.
CPC ..... *F17C 7/04* (2013.01); *F17C 7/02* (2013.01); *F17C 2227/0302* (2013.01); *F17C 2227/0309* (2013.01); *F17C 2265/04* (2013.01)

(58) Field of Classification Search
CPC ..... F17C 7/02; F17C 7/04; F17C 9/02; F17C 9/04; F17C 2227/0302; F17C 2227/0309; F17C 2227/0316; F17C 2265/05
See application file for complete search history.

(56) References Cited

U.S. PATENT DOCUMENTS

| | | | | |
|---|---|---|---|---|
| 6,644,041 | B1 * | 11/2003 | Eyermann | F17C 9/02 62/50.2 |
| 9,885,446 | B2 * | 2/2018 | Kim | F17C 7/02 |
| 2010/0146971 | A1 * | 6/2010 | Mak | F01K 13/00 60/651 |
| 2011/0132003 | A1 * | 6/2011 | Pozivil | F17C 7/04 62/45.1 |
| 2011/0167824 | A1 * | 7/2011 | Mak | F17C 5/06 60/651 |

FOREIGN PATENT DOCUMENTS

| | | |
|---|---|---|
| CN | 104197576 | 12/2014 |
| CN | 204301358 | 4/2015 |

* cited by examiner

*Primary Examiner* — Brian M King
(74) *Attorney, Agent, or Firm* — ScienBiziP, P.C.

(57) ABSTRACT

A heat exchange system includes a cold source, a heat dissipation apparatus, a water storage tank, a heating portion, and a cooling portion. The heating portion is coupled between the cold source and the water storage tank. The cooling portion is coupled between the heat dissipation apparatus and the water storage tank. The cooling portion transmits heat of the heat dissipation apparatus to water of the water storage tank to cool the heating portion, and the heating portion transmits heat of the water of the water storage tank to the cold source to heat the cold source.

16 Claims, 11 Drawing Sheets

HEAT EXCHANGE SYSTEM BETWEEN LIQUEFIED NATURAL GAS AND HEAT DISSIPATION APPARATUS

CROSS-REFERENCE TO RELATED APPLICATIONS

This application claims priority to Chinese Patent Application No. 201610126534.8 filed on Mar. 7, 2016, the contents of which are incorporated by reference herein.

FIELD

The subject matter herein relates to a heat exchange system between liquefied natural gas and heat dissipation apparatus.

BACKGROUND

In one aspect, liquefied natural gas (LNG) needs to absorb heat to be gasified. In another aspect, a heat dissipation apparatus, such as data center generates a lot of heat which needs to be dissipated.

BRIEF DESCRIPTION OF THE DRAWINGS

Implementations of the present technology will now be described, by way of example only, with reference to the attached figures.

DETAILED DESCRIPTION

Figure 1:
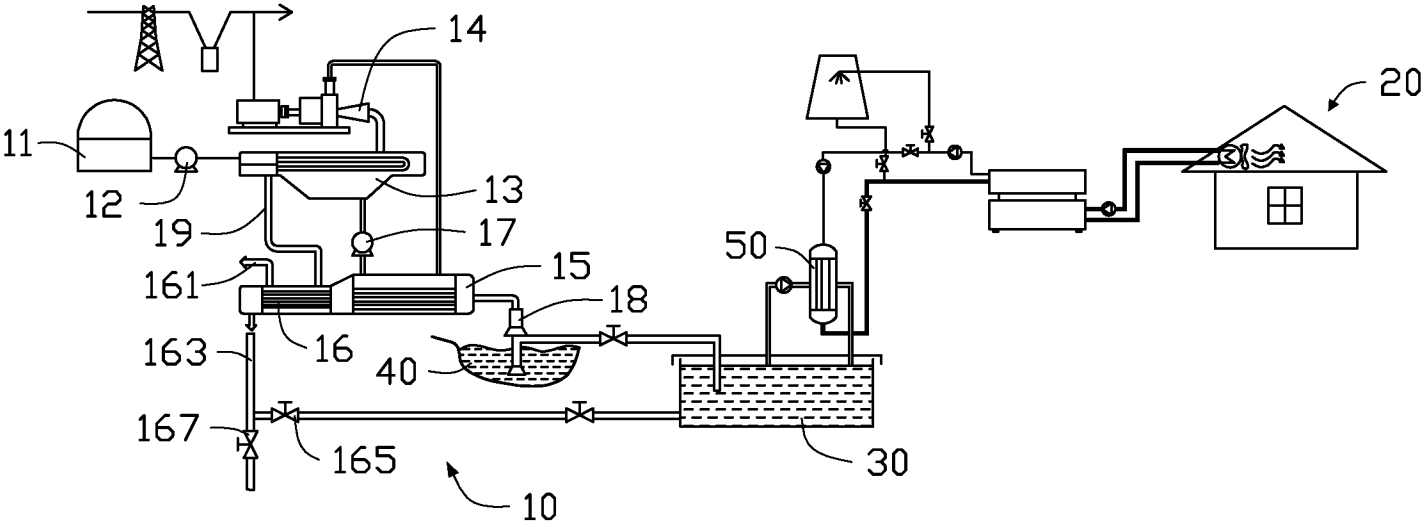
FIG. 1 is diagrammatic view of a heat exchange system in one embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series and the like.

FIG. 1 illustrates that a heat exchange system for exchanging heat between liquefied natural gas (LNG) and a data center. The heat exchange system includes a heating portion 10, a cooling portion 20, and a water storage tank 30. The heating portion 10 is configured to LNG which is stored in a LNG tank 11. The cooling portion 20 is configured to cool a heat dissipation apparatus, such as a data center, a workshop, an office building, and so on.

The heating portion 10 includes a first pump 12, a first heat exchanger 13, a turbine 14, a second heat exchanger 15, a third exchanger 16, a second pump 17, a third pump 18, and a pipe 19. The first pump 12 is coupled between the LNG tank 11 and the first heat exchanger 13. The pipe 19 is coupled between the first heat exchanger 13 and the third heat exchanger 16 to transmit natural gas to the third heat exchanger 16 from the first exchanger 13.

The third pump 18 is coupled between water storage tank 30 and the second heat exchanger 15. The third pump 18 is configured to pump water from the water storage tank 30 into the second heat exchanger 15. Further, the third pump 18 can pump water from a pool 40 into the second heat exchanger 15 when the water in the water storage tank 30 is not needed. The second exchanger 15 is coupled to the third exchanger 16 and transmits water to the third exchanger 16. A plurality of intermediate heating medium are filled in the second heat exchanger 15. The plurality of intermediate heating medium is separated from water pumped by the third pump 18. The plurality of intermediate heating medium is configure to absorb heat of the water in the heat exchanger 15.

The second heat exchanger 15, the second pump 17, the first heat exchanger 14, and the turbine 14 make up of a loop for the plurality of intermediate heating medium flowing therein. The second pump 17 works to drive the intermediate heating medium to flow from the second heat exchanger 15 into the first heat exchanger 13, and then flow through the turbine 14 to rotate the turbine 14 to generate electric power which is provided to a electric power system (not labeled), and at last flow back to the second heat exchanger 15. In the first heat exchanger 13, the intermediate heating medium and the LNG are separated, and heat of the intermediate heating medium is transmitted to the LNG.

The third exchanger 16 includes a gas outlet 161 and a water outlet. In the third exchanger 16, LNG flowing from the first heat exchanger 13 and water flowing from the second heat exchanger 15, and heat of the water is transmitted to the LNG to gasify the LNG. The gasified LNG is outputted from the gas outlet 161. Water flows out of the third exchanger 16 via the water outlet 163. Water can flow back to the water storage tank 30 via a first valve 165, or be discharged via a second valve 167.

Figure 2:
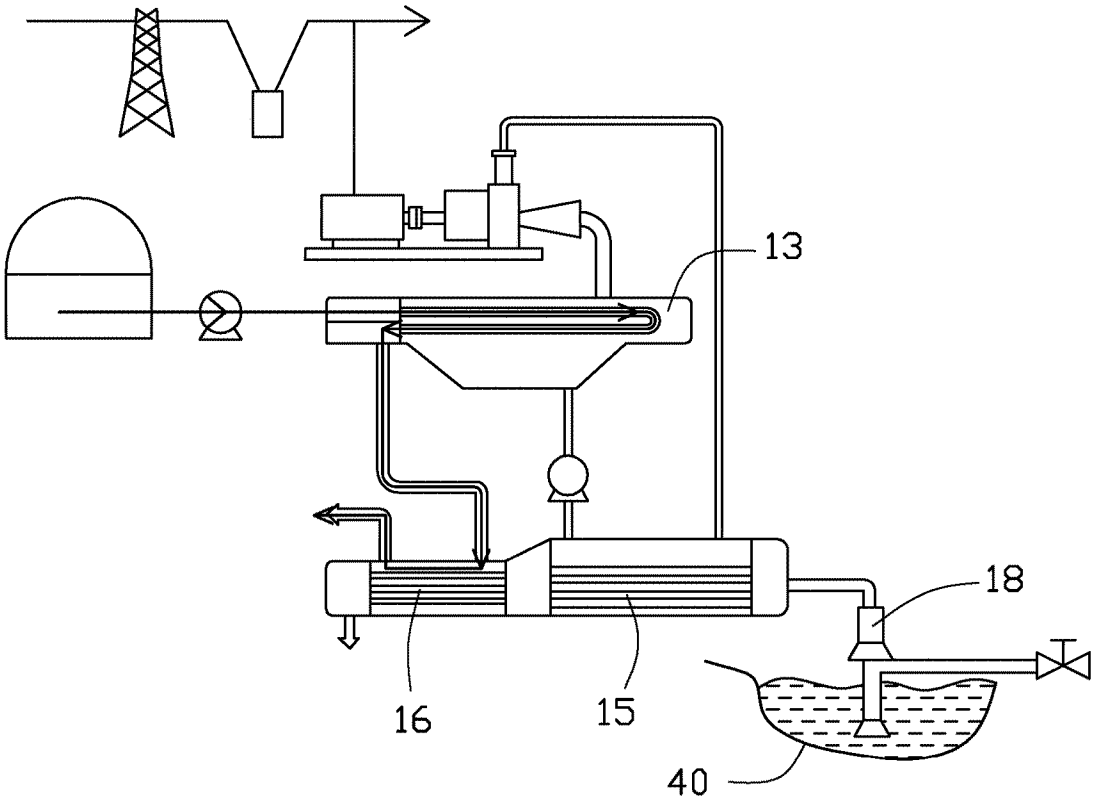
FIG. 2 is a diagrammatic view of a heating portion of the heat exchange system of FIG. 1.

FIG. 2 illustrates the LNG flowing in the heating portion 10. The LNG flows past the first heat exchanger 13 and the third heat exchanger 16 to be gasified. When LNG is located in the first heat exchanger 13, heat of the intermediate heating medium is transmitted to the LNG. When LNG is located in the first heat exchanger 13, heat of water is transmitted to the LNG.

Figure 3:
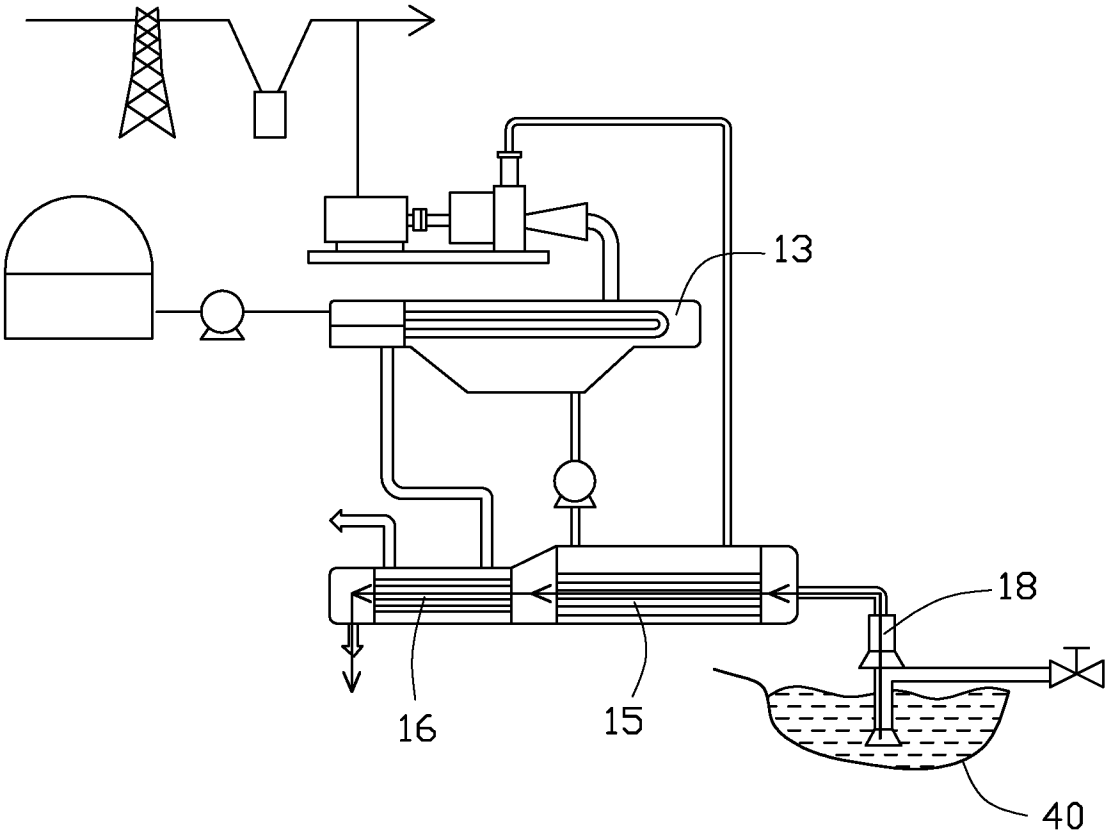
FIG. 3 is another diagrammatic view of a heating portion of the heat exchange system of FIG. 1.

FIG. 3 illustrates the water flowing in the heating portion 10. Water pumped from the water storage tank 30 or the pool 40 flows past the second heat exchanger 15 and the third heat exchanger 16. When water is located in the second heat exchanger 15, heat of the water is transmitted to the intermediate heating medium. When water is located in the second heat exchanger 15, heat of the water is transmitted to the LNG.

Figure 4:
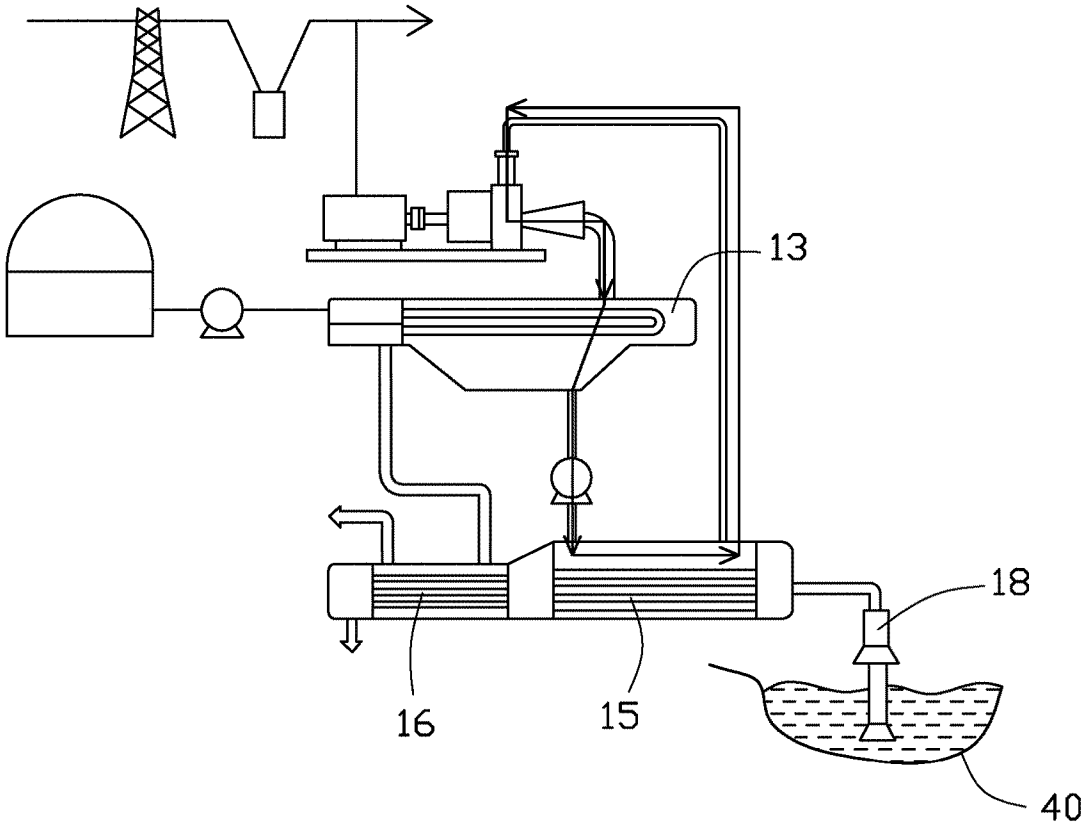
FIG. 4 is another diagrammatic view of a heating portion of the heat exchange system of FIG. 1.

FIG. 4 illustrates the intermediate heating medium flowing in the loop. The intermediate heating medium flows from second heat exchanger 15 to the first heat exchanger 13 and back to the second heat exchanger 15. When the intermediate heating medium is located in the second heat exchanger 15, heat of the water is transmitted to the intermediate heating medium. When the intermediate heating medium is located in the first heat exchanger 13, heat of the intermediate heating medium is transmitted to the LNG.

In another embodiment, the first exchanger 13, the second exchanger 15, and the turbine 14 can be omitted. The third exchanger 16 is provided to heat the LNG by water.

Figure 5:
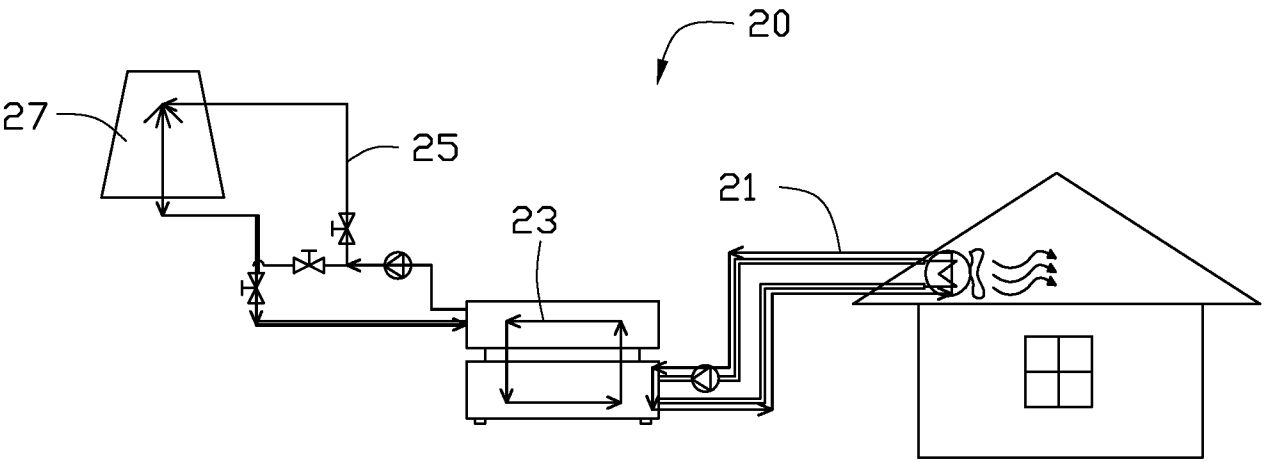
FIG. 5 is a diagrammatic view of a cooling portion of the heat exchange system of FIG. 1.

FIG. 5 illustrates that the cooling portion 20 includes an chilled water loop 21, a cooling medium loop 23, and a cooling water loop 25. Chilled water flows in the chilled water loop 21 to absorbs heat of a heat dissipation apparatus via a fourth heat exchanger (not shown) and dissipate heat to cooling medium of the cooling medium loop 23. The cooling medium dissipates heat to cooling water of the cooling water loop 25 via a fifth exchanger (not shown). The cooling water of the cooling water loop 25 flows through a water tower 27 to dissipate heat of the cooling water. In one embodiment, the cooling medium loop 23 includes a compressor to add pressure to the cooling medium.

Figure 6:
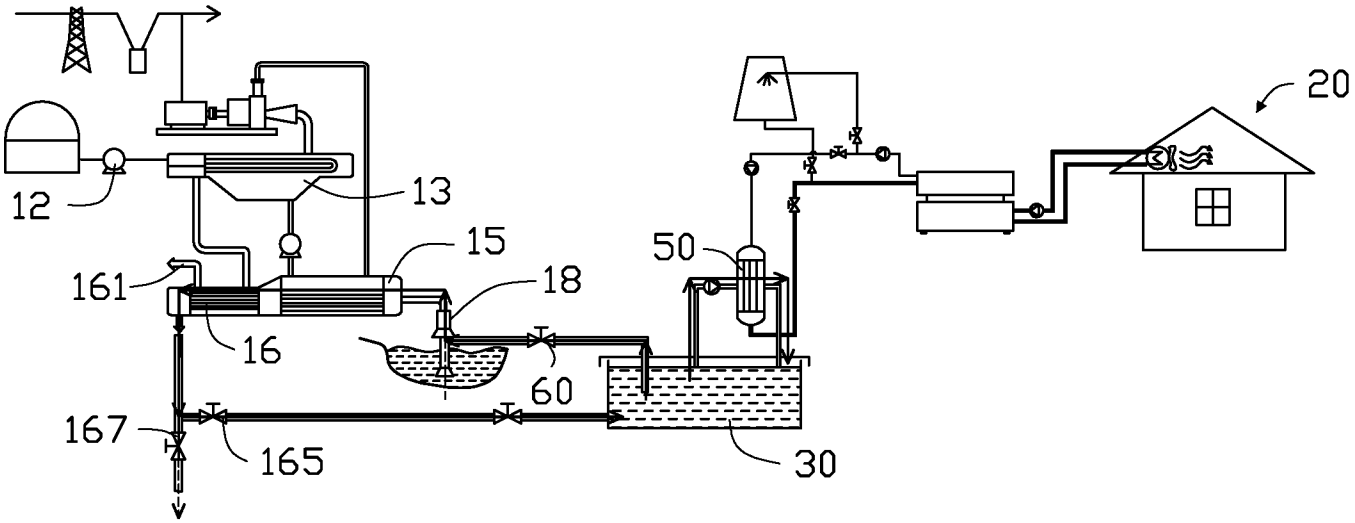
FIG. 6 is diagrammatic view of a heat exchange system in another embodiment.

FIG. 6 illustrates that the cooling water loop 25 includes a sixth heat exchanger 50 which is coupled to a water tower 27 and the cooling medium loop 23. Further, the sixth heat exchanger 50 is coupled to the water storage tank 30. Thus, the cooling water of cooling water loop 25 transmits heat to the water of the water storage tank 30 via the sixth heat exchanger 50.

A valve 60 is coupled between the water storage tank 30 and the third pump 18. When the valve 60 is opened, the pump 18 works to pump the water of the water storage tank 30 to the second heat exchanger 15 and the third heat exchanger 16. In another embodiment, the pump 18 can simultaneously pump the water of the water storage tank 30 and the pool 40 in a preset ratio.

In the above embodiment, heat of the heat dissipation apparatus is transmitted to the water of the water storage tank 30 via the chilled water loop 21, the cooling medium loop 23, and the cooling water loop 25 of the cooling portion 20. Heat of the water of the water storage tank 30 is transmitted to the LNG via the first heat exchanger 13, the second heat exchanger 15, and the third heat exchanger 16 of the heating portion 10. Therefore, the heat of the heat dissipation apparatus is exchanged to the LNG via the heat exchange system.

Figure 7:
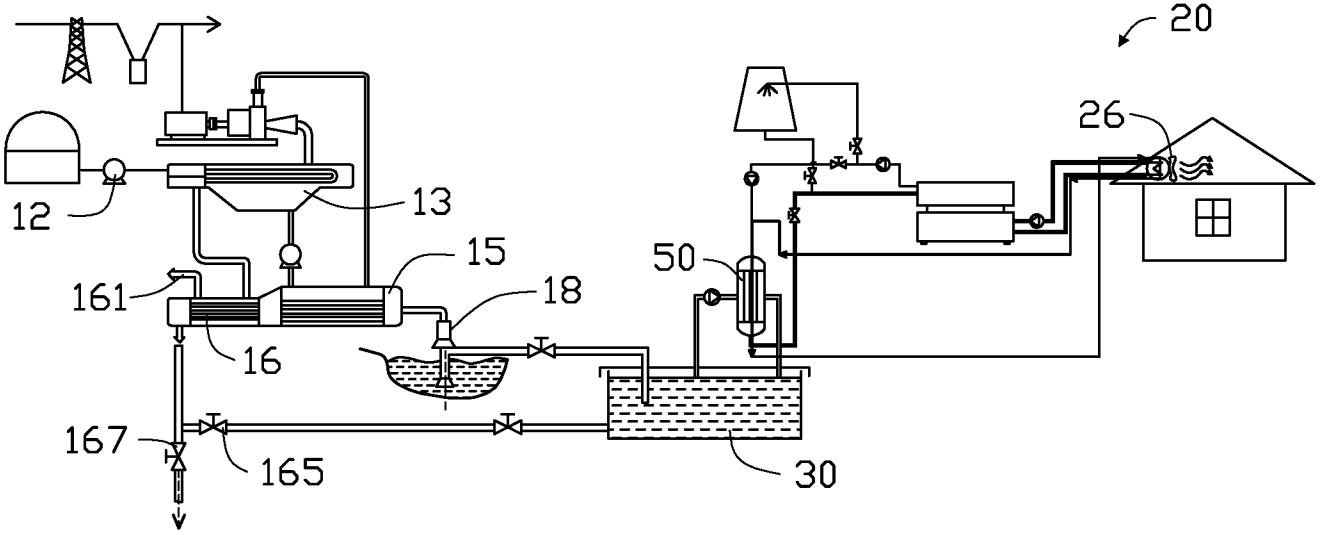
FIG. 7 is diagrammatic view of a heat exchange system in another embodiment.

FIG. 7 illustrates another embodiment of heat exchange system. In this embodiment, there is a pipe is connected between the sixth heat exchanger 50 of the cooling water loop 25 and the chilled water loop 21. When a temperature of the water in the water storage tank 30 is lower than a lowest temperature of the chilled water in the chilled water loop 21, the chilled water of the chilled water loop 21 flows in the sixth heat exchanger 50 to dissipate heat to the water of the water storage tank 30. Further, the chilled water loop 21 includes a fan 26 which is a heat exchanger for exchanging heat of air to the chilled water of the water storage tank 30.

In another embodiment, when the LNG is not enough, and cannot absorb all heat of the heat dissipation apparatus, the chilled water loop 21, the cooling medium loop 23, and the cooling water loop 25 can be enhanced to dissipate more heat of the heat dissipation apparatus.

Figure 8:
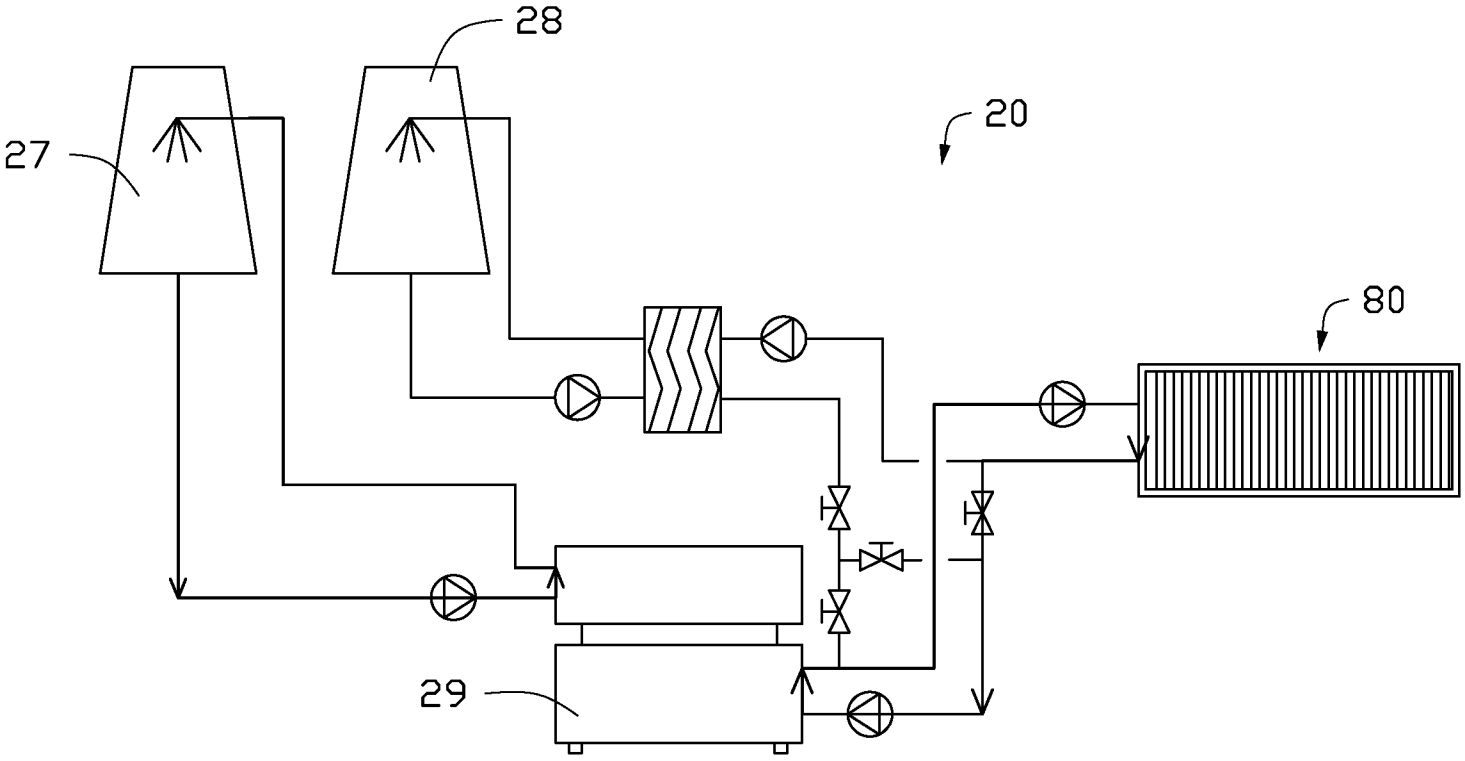
FIGS. 8 and 9 are diagrammatic views of a heat exchange system in another embodiment.
Figure 9:
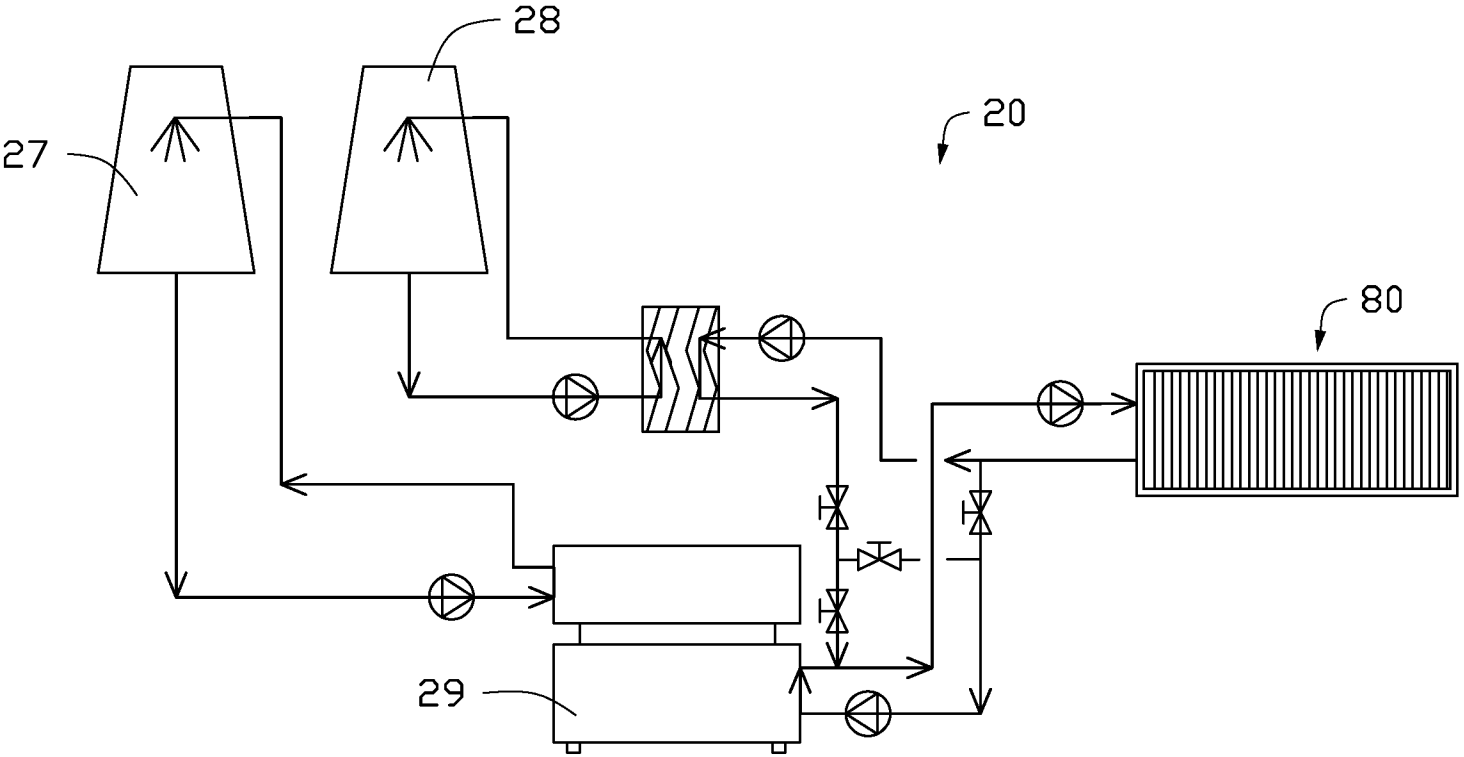

FIGS. 8 and 9 illustrates another embodiment of heat exchange system. In this embodiment, the cooling water loop 25 of the cooling portion 20 further includes another water tower 28. When the surrounding temperature is low, the water tower 28 can dissipate heat of the chilled water of the chilled water loop 21. Therefore, a work load of a compressor 29 of the cooling medium loop 23 can be reduced to save power. When the surrounding temperature is not low, the water tower 28 does not work, and the compressor 29 works in great power to absorb more heat of the chilled water. Therefore, the heat dissipation apparatus 80 can be cooled.

Figure 10:
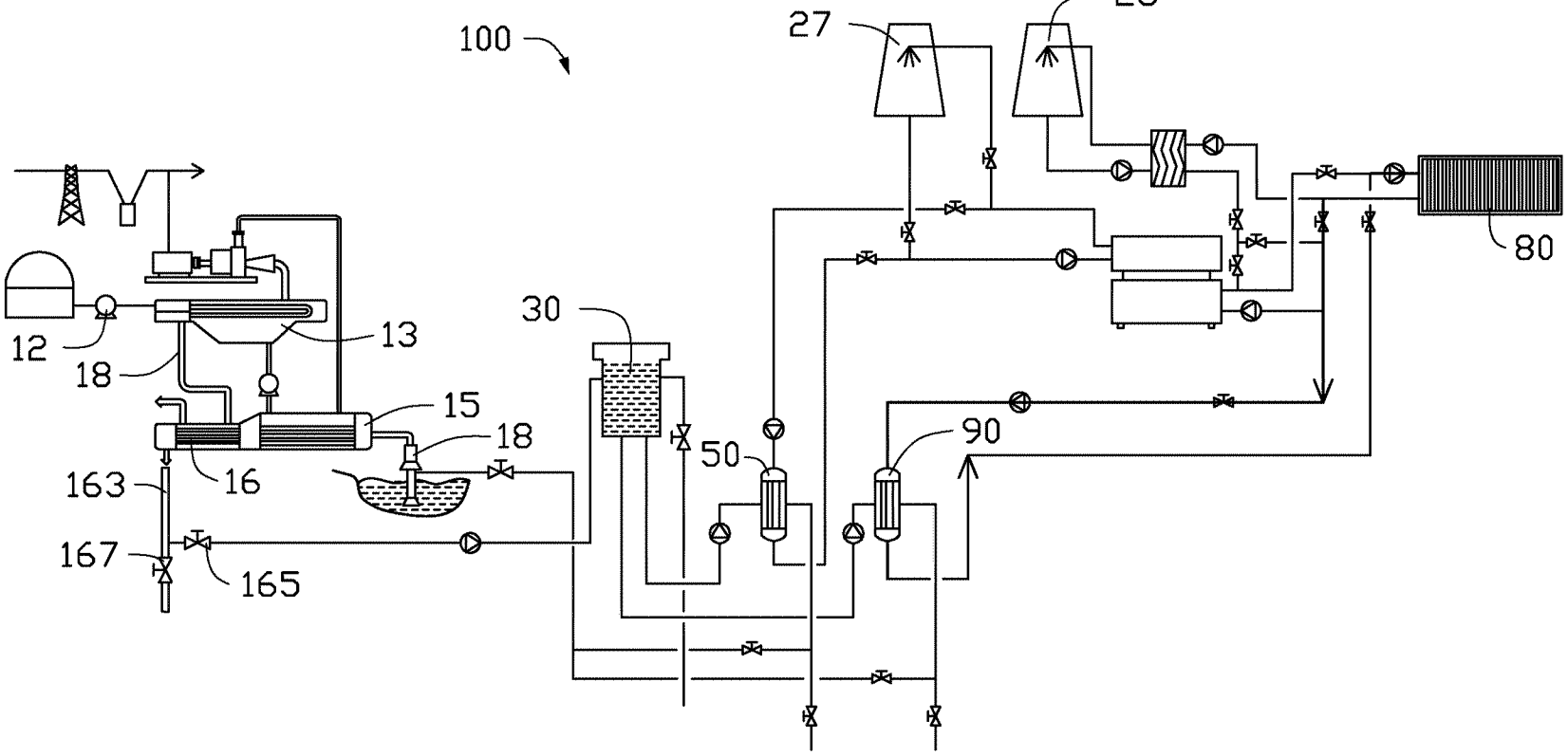
FIGS. 10 and 11 are diagrammatic views of a heat exchange system in another embodiment.
Figure 11:
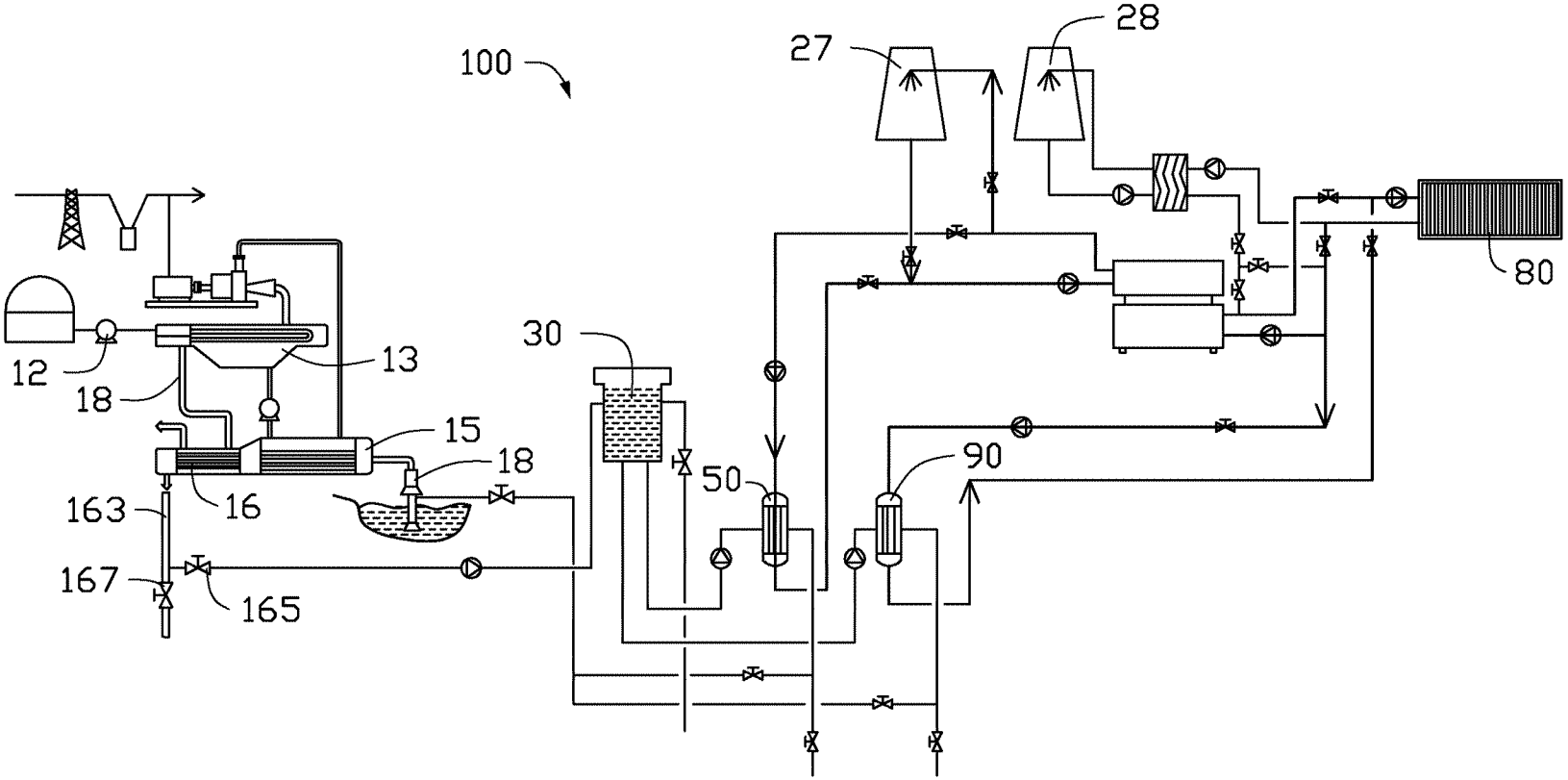

FIGS. 10 and 11 illustrate another embodiment of the heat exchange system. In this embodiment, the heat exchange system further includes a seventh heat exchanger 90 which is coupled between the chilled water loop 21 and the water storage tank 30. When a temperature of the water in the water storage tank 30 is lower than the lowest temperature of the chilled water in the chilled water loop 21, the chilled water of the chilled water loop 21 flows in the seventh heat exchanger 90 to dissipate heat to the water of the water storage tank 30 directly. When the temperature of the water in the water storage tank 30 is located between the lowest temperature of the chilled water and the highest temperature of the chilled water, the sixth heat exchange 50 and the seventh heat exchanger 90 work simultaneously to dissipate heat of the chilled water.

In another embodiment, when the LNG can absorb more heat than that dissipated from the heat dissipation apparatus, more water in the water storage tank 30 or other container can be cooled to cool other heat dissipation apparatus. In another aspect, when the heat dissipation apparatus dissipates more heat than that the LNG can be absorbed, more water in the water storage tank 30 or other container can be heated to heat other apparatus.

In other embodiment, the LNG can be replaced by other cold source which needs to be heated, such as liquid nitrogen, liquid ammonia, and so on.

The embodiments shown and described above are only examples. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A heat exchange system comprising:

a cold source;

a heat generation source that releases heat during a predetermined state;

a water storage tank;

a first heat exchanger coupled between the cold source and the water storage tank; and a second heat exchanger coupled between the heat generation source and the water storage tank;

wherein the second heat exchanger transmits heat of the heat generation source to water of the water storage tank to cool the heat generation source, and the first heat exchanger transmits heat of the water of the water storage tank to the cold source to heat the cold source; and wherein the second heat exchanger comprises a chilled water loop, a cooling medium loop, and a cooling water loop, and chilled water flows in the chilled water loop to absorbs heat of the heat generation source and dissipates heat to cooling medium of the cooling medium loop, the cooling medium dissipates heat to cooling water of the cooling water loop, and the cooling water of the cooling water loop transmits heat to water of the water storage tank.

2. The heat exchange system of claim 1, wherein the cold source is LNG which is stored in a LNG tank.

3. The heat exchange system of claim 1, wherein the first heat exchanger comprises a first sub heat exchanger and a second sub heat exchanger, the first sub heat exchanger and the second sub heat exchanger are coupled to form a loop, a plurality of intermediate heating medium flows in the loop, water of the water storage tank flows in the second sub heat exchanger to transmit heat to the plurality of intermediate heating medium, and the cold source flows in the first sub heat exchanger to absorb heat of the plurality of intermediate heating medium.

4. The heat exchange system of claim 3, wherein the cold source and the intermediate heating medium are separated in the first sub heat exchanger, and the intermediate heating medium and the water are separated in the second sub heat exchanger.

5. The heat exchange system of claim 3, wherein a first pump is coupled between the cold source and the first sub heat exchanger, and the first pump is configured to pump the cold source into the first sub heat exchanger.

6. The heat exchange system of claim 3, wherein a second pump is coupled between the first sub heat exchanger and the second sub heat exchanger, and the second pump is configured to drive the plurality of intermediate heating medium to flow in the loop.

7. The heat exchange system of claim 6, wherein a turbine is located in the loop, and the plurality of intermediate heating medium is configured to flow through the turbine to rotate the turbine to generate electric power.

8. The heat exchange system of claim 3, wherein a third pump is coupled between the second sub heat exchanger and the water storage tank, and the third pump is configured to pump water of the water storage tank into the second sub heat exchanger.

9. The heat exchange system of claim 3, wherein the first heat exchanger further comprises a third sub heat exchanger, and the cold source is configured to flow from the first sub heat exchanger into the third sub heat exchanger, and the water in the second sub heat exchanger is configured to flow into the third sub heat exchanger to dissipate heat to the cold source.

10. The heat exchange system of claim 9, wherein the third sub heat exchanger comprises a gas outlet, and the cold source is configured to be gasified in the third sub heat exchanger and be outputted via the gas outlet.

11. The heat exchange system of claim 9, wherein the third sub heat exchanger comprise a water outlet, and water in the third sub heat exchanger is configured to flow out of the third sub heat exchanger and flow back to the water storage tank.

12. The heat exchange system of claim 1, wherein the cooling water of the cooling water loop transmits heat to the water of the water storage tank via a first sub heat exchanger.

13. The heat exchange system of claim 12, wherein the cooling water loop comprises a water tower to dissipate heat of the cooling water.

14. The heat exchange system of claim 12, wherein the chilled water loop is coupled to the first sub heat exchanger, and the chilled water of the chilled water loop is configured to flow in the first sub heat exchanger to dissipate heat to the water of the water storage tank when a temperature of the water in the water storage tank is lower than a lowest temperature of the chilled water in the chilled water loop.

15. The heat exchange system of claim 12, wherein the first heat exchanger comprises a water tower coupled to the chilled water loop, and the water tower is configured to dissipate heat of the chilled water of the chilled water loop.

16. The heat exchange system of claim 12, wherein a second sub heat exchanger is coupled between the chilled water loop and the water storage tank, and the second sub heat exchanger is configured to transmit heat of chilled water of the chilled water loop to water of the water storage tank.

* * * * *